United States Patent [19]

Frosch

[11] 4,287,838

[45] Sep. 8, 1981

[54] FLUIDIZED BED COAL COMBUSTION REACTOR

[76] Inventors: Robert A. Frosch, Administrator of the National Aeronautics and Space Administration, with respect to an invention of; Philip I. Moynihan, La Canada; Donald L. Young, Pasadena, both of Calif.

[21] Appl. No.: 969,759

[22] Filed: Dec. 15, 1978

[51] Int. Cl.[3] ..... F23B 7/00

[52] U.S. Cl. ..... 110/234; 110/255; 110/266; 110/245; 122/4 D

[58] Field of Search ..... 110/243–245, 110/248, 251, 252, 255, 259, 266, 167, 234; 122/4 D

[56] References Cited

U.S. PATENT DOCUMENTS

| | | | |
|---|---|---|---|
| 510,788 | 12/1893 | Hawkins . | |
| 1,606,720 | 11/1926 | Pollock . | |
| 1,714,678 | 5/1929 | Kreisinger . | |
| 1,849,095 | 3/1932 | Keenan, Jr. | 110/266 |
| 3,625,165 | 12/1971 | Ishigaki | 110/245 |
| 3,776,150 | 12/1973 | Evans et al. | 110/245 |
| 4,096,909 | 6/1978 | Jukkola | 122/4 D |
| 4,099,473 | 7/1978 | Mackenzie et al. | 110/255 |
| 4,159,000 | 6/1979 | Iwasaki et al. | 110/244 |

*Primary Examiner*—Henry C. Yuen

*Attorney, Agent, or Firm*—Monte F. Mott; John R. Manning

[57] ABSTRACT

A fluidized bed coal reactor includes a combination nozzle-injector ash-removal unit formed by a grid of closely spaced open channels, each containing a worm screw conveyor, which function as continuous ash removal troughs. A pressurized air-coal mixture is introduced below the unit and is injected through the elongated nozzles formed by the spaces between the channels. The ash build-up in the troughs protects the worm screw conveyors as does the cooling action of the injected mixture. The ash layer and the pressure from the injectors support a fluidized flame holder combustion zone above the grid which heats water in boiler tubes disposed within and/or above the combustion zone and/or within the walls of the reactor.

8 Claims, 4 Drawing Figures

FLUIDIZED BED COAL COMBUSTION REACTOR

ORIGIN OF THE INVENTION

The invention described herein was made in the performance of work under a NASA contract and is subject to the provisions of Section 305 of the National Aeronautics and Space Act of 1958, Public Law 83-568 (72 Stat. 435; 42 USC 2457).

BACKGROUND OF THE INVENTION

1. Field of the Invention

The present invention relates to fluidized bed coal combustion and, more particularly, to a reactor incorporating a nozzle injector formed by a continuous ash removal assembly.

2. Description of the Prior Art

The U.S. reserve of coal is about 3 trillion tons. Although the most abundant (80%) fossil fuel in Amercia is coal, the U.S. consumption pattern is quite a reversal of form in terms of utilization, with coal representing only 17%, oil and gas about 78%.

The demand for all the fossil fuels combined is expected to double by the year 2000, even with the increasing use of nuclear power. While the domestic supply of crude oil and natural gas is not likely to keep apace with the energy demand, coal can play an important role in filling such a gap and thus reduce the requirements for imported supplies of oil and gas.

Coal, the fossilized plant life of prehistoric times, contains various amounts of sulfur due to the nature of its origin. Under most existing commercial technology, the generation of electricity from coal poses environmental problems because of sulfur oxides and particulate emissions. Since most of the coals in this country, particularly the Eastern and Midwestern coals, have high sulfur content (>2%) there is a need for an economical process of converting high sulfur coals to electrical energy (<1.2 lbs of $SO_2$ emission per million BTU thermal output by EPA standard) without causing serious air pollution. If the vast coal reserve can be cleanly converted, it can supply most of the energy needs of the United States for the next three centuries.

At the present time, about one-half of the electric power in the United States is generated from natural gas and petroleum; most of the other half is from coal. If coal can be utilized for electric utilities, petroleum and natural gas would be released for other essential uses, especially as a starting material for the synthetic rubber and plastics industry.

Because of the critical domestic shortages in petroleum and natural gas, it is imperative that methods be developed to burn coal directly in an environmentally acceptable manner, and with maximum thermal efficiency. For the near term, however, there is a need for conventional coal-fired systems, particularly pulverized coal-fired (PCF) steam generators, and for rapid development of large pressurized, high temperature fluidized-bed reactors.

Fluidized bed combustion of coal differs significantly from conventional modes of firing coal such as mechanical stokers, PCF and cyclone. Crushed and sized coal is burnt in a bed of ash and lime or dolomite (sulfur scavenger) that is fluidized with air. This system utilizing high pressure and temperature has potential for more efficient and reliable boilers and for low sulfur oxide and nitrogen oxide emissions.

It should be noted that coal feedstocks may contain up to 11 wt.% of ash, which when combined with the ash generated during combustion as well as the ash from the added limestone, contributes to a rapid build-up which cannot be readily dumped from the high pressure vessel conventional fluidized bed reactors.

Another problem in addition to ash removal with conventional fluidized bed coal reactors is the containment of coal particles in the proper combustion zone. The known prior art fluidized bed systems often have coal combustion and particle ignition adjacent to the porous inlet grid. The hottest portion of the flame is often too far from the boiler tubes for efficient utilization of the thermal values.

SUMMARY OF THE INVENTION

A high-temperature, high-pressure, fluidized bed coal reactor with convenient particulate and ash removal is provided in accordance with this invention. The system of the invention utilizes the benefits offered by fluidized bed operation and since the reactor is operated at high pressure, from 100 psia to 500 psia or more and high temperature from 1000° F. to 2000° F., a much smaller reactor can be utilized to produce the same thermal values or steam values as are provided in conventional fluidized bed gasification or boiler units. Thus, the system of the invention provides net reduction of manufacturing and assembly costs by permitting major sections of the unit to be manufactured at the factory, shipped by rail to the power generation plant for on-site assembly.

A fluidized bed coal reactor in accordance with this invention includes a combination nozzle injector ash-removal unit formed by a grid of closely spaced open channels, each containing a worm screw conveyor, which function as continuous ash removal troughs. A pressurized air-coal mixture is introduced below the unit and is injected through the elongated nozzles formed by the gaps between the channels. The ash build-up in the troughs protects the worm screw conveyors as does the cooling action of the injected mixture. The ash layer and the pressure from the injectors support a fluidized flame holder combustion zone above the gird which heats water in boiler tubes disposed within or above the combustion zone of within the walls of the reactor.

The ash build-up in the trough with the worm screw conveyor provides a compacted ash column which acts as a seal between the interior of the reactor and the exterior ash removal sleeve. The ash build-up also provides a thermal blanket protecting the worm gear from the heat of combustion and provides a natural bed to support the fluidized coal bed during combustion. The upwardly rising stream of coal and air provides further cooling of the nozzle grid and ash removal unit. Low combustion temperatures of the order of 1500° F. at about 300 psia with low $NO_x$ emission can be achieved.

The system of the invention with a one-dimensional channel nozzle structure achieves both flow control of the inlet air/coal mixture and flameholding of the fuel/air mixture while simultaneously achieving continuous, simple ash removal. Another important feature in the containment of coal particles is the proper combustion zone. The combusting coal particles are suspended downstream of the nozzle-channel injector in the vicinity of the boiler tube array in a flameholder-like fashion, resulting in more efficient heat transfer and providing lower temperatures in the ash removal section of the system.

These and many other features and attendant advantages of the invention will become readily apparent as the invention becomes better understood by reference to the following detailed description when considered in conjunction with the accompanying drawings.

DESCRIPTION OF THE PREFERRED EMBODIMENTS

Figure 1:
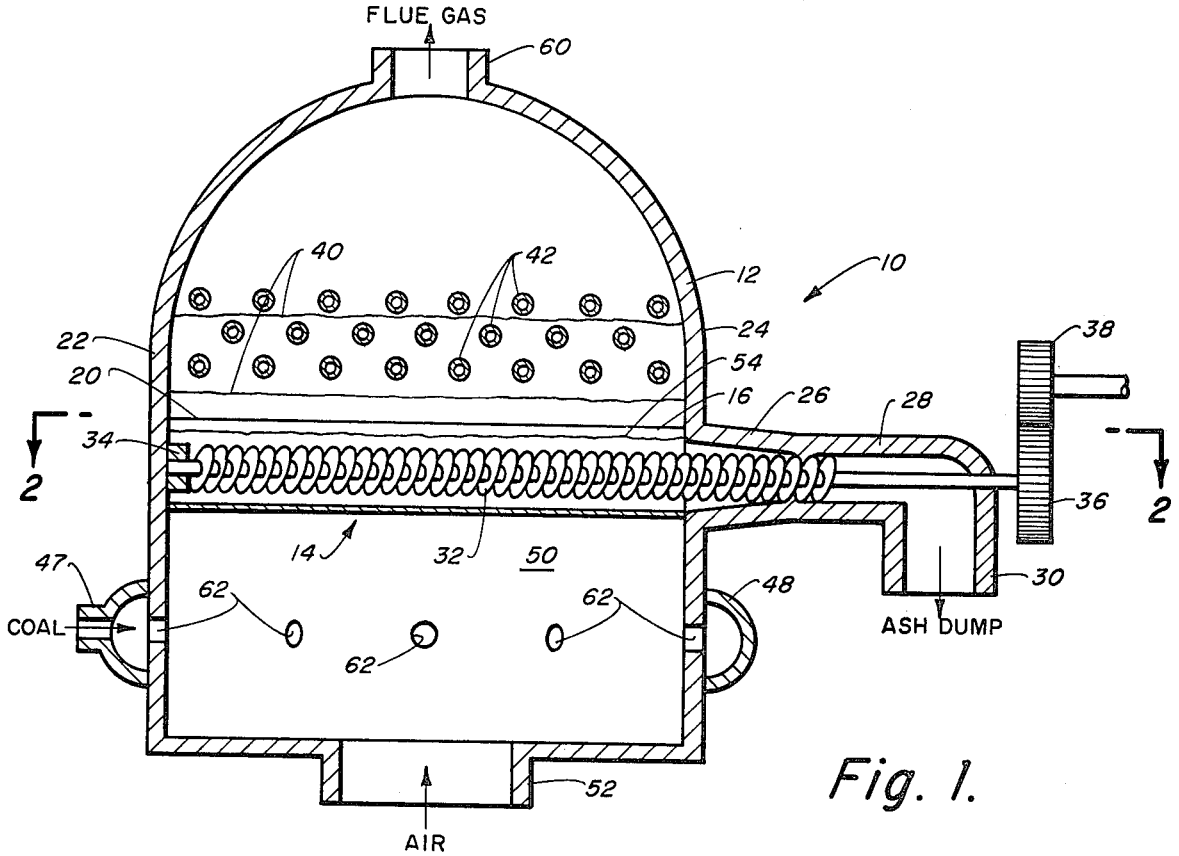
FIG. 1 is a cross-section of fluidized bed coal reactor containing an injector-nozzle ash-removal assembly in accordance with this invention showing the worm screw and ash removal sleeve.
Figure 2:
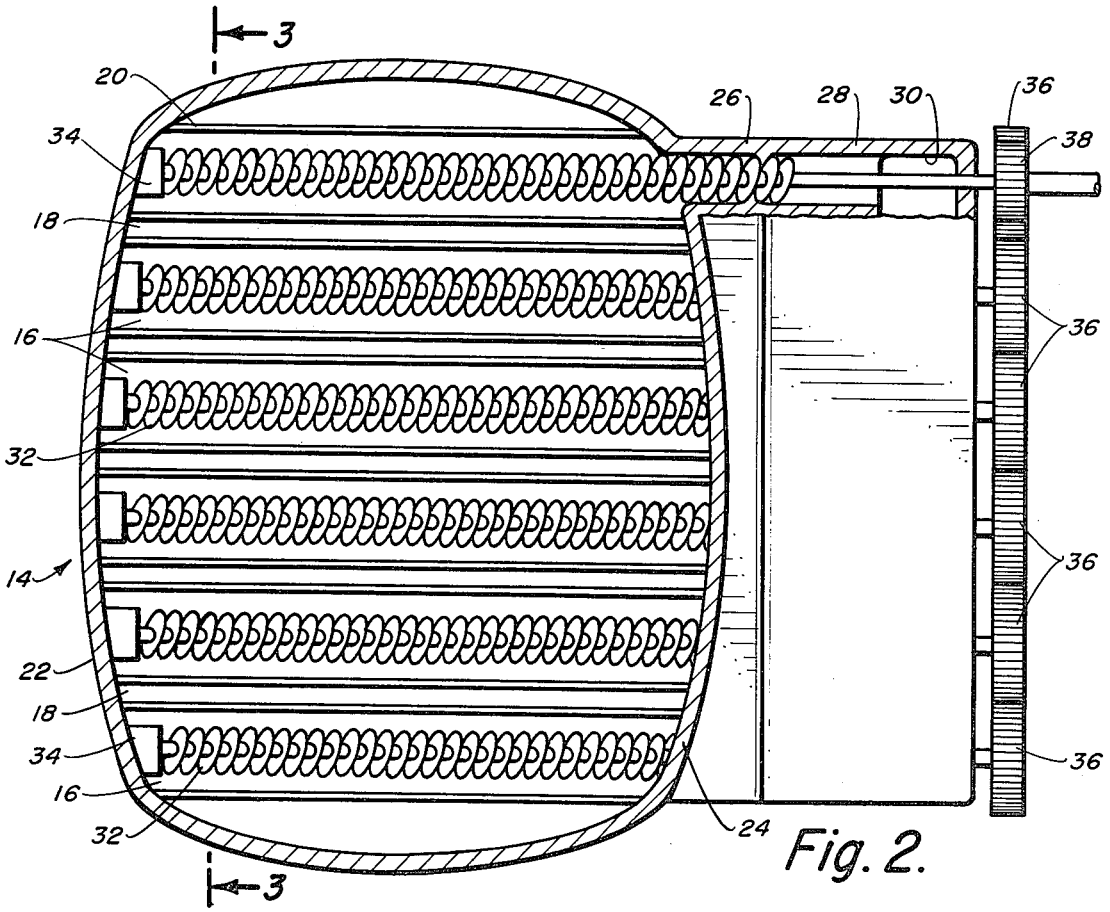
FIG. 2 is a further sectional view along line 2—2 of FIG. 1.
Figure 3:
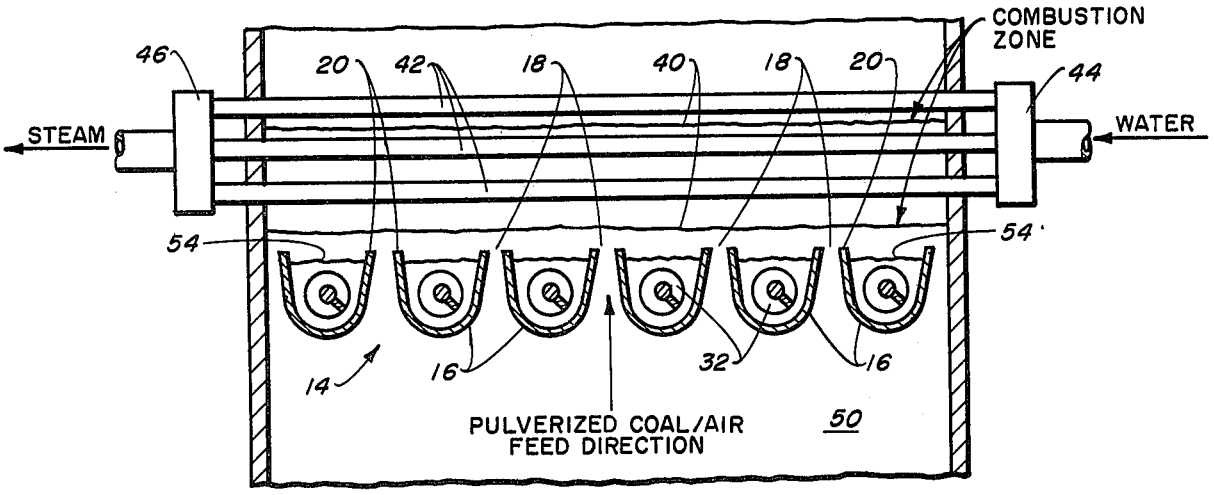
FIG. 3 is an additional sectional view along line 3—3 of FIG. 2.

Referring now to FIGS. 1, 2 and 3, the fluidized bed combustion reactor 10 generally includes an elongate vertical shell 12 having supported, horizontally therein a grid 14 of closedly spaced, channels 16. The spacing between each channel forms an elongate nozzle opening 18. The spacing is selected based on the issue design requirements of the specific combustion reactor and on the size of the carbonaceous solid feed and any additive such as lime or lime or limestone, but the spacing is generally from 1/16 to 1.0 inch for powdered coal, preferably from $\frac{1}{8}$ to $\frac{1}{2}$ inch.

The channels 16 are generally U-shaped having upwardly facing diverging ends 20 which contribute to collection of downwardly falling ash and channel the upwardly rising suspension into the elongate nozzle openings 18. The channels 16 are located in a mid-section of the reactor 10 which is preferably but not necessarily of rectangular shape at this location. Each channel 16 is secured to walls 22, 24 of the reactor 10 such as by welding. End wall 24 contains a plurality of conical outlets 26 joined to elongated ash removal sleeves 28, each of which terminates in a downwardly directed chute 30.

A worm screw 32 is disposed in each channel 16 supported at wall 22 by a bearing mount 34 and extending through each outlet 26 through sleeve 28 and shute 30 to a rotating means such as gear 36 connected to drive gear 38.

Pulverized coal and air are delivered to the reactor below the grid 14 and form a suspension whcih is injected through the elongate nozzle openings 18 into the combustion zone 40 which encompasses the bank of boiler tubes 42. The tubes are connected to an inlet water manifold 44 and an outlet stream manifold 46. Coal is suitably fed from a storage source not shown through inlet 47. The coal is then distributed to the combustion reactor by an injection means such as manifold 48 encircling the reactor 10. The coal is injected into the lower chamber 50 of the reactor through parts or nozzles 62, mixes with the stream of air entering through bottom air inlet 52 to form a suspension which is channeled by the grid 14 of channels 16, pass through the nozzles 18 which introduce and distribute the mixture to form a fluidized suspension within combustion zone 40. The combustion gases leaves reactor 10 through flue 60. It is also believed that the dynamic pressure and downstream vortices of the air-fuel mixture passing through will also establish eddies that will aid in accumulating ash 54 within the concave surface of the channels 16 which also function as ash troughs.

After a period of operation, sufficient ash accumulates in the troughs of the channels 16 to cover the worm screw 32 and fill the outlet 26. Operation of the worm screw 32 which closely fits the ash removal sleeve 28 will act to pull the excess ash from the channel, compact it into the sleeve which forms a high pressure seal permitting continuous, single ash removal. Furthermore, the natural bed 54 of ash building up on the worm screw 32 provides a thermal blanket protecting the worm screw from the heat of combustion and also helps to support the coal during combustion. The high velocity upstream injection of the coal/air mixture also acts to cool the nozzle grid 14 and worm screws 32.

Overall low combustion temperatures of about 1500° F. at a fluidized bed feed pressure of about 300 psia with low $NO_x$ emissions can be achieved in the reactor of the invention. The reactor of the invention can be utilized with solid or liquid carbonaceous feeds resulting in high ash contents such as coals of all types, oil shale, tars, sludge, pulping wastes, etc. High sulfur content feeds can be processed by simultaneous injection of a sulfur scavenger such as lime or limestone. Sulfur can readily be recovered from the CaS by-product.

Figure 4:
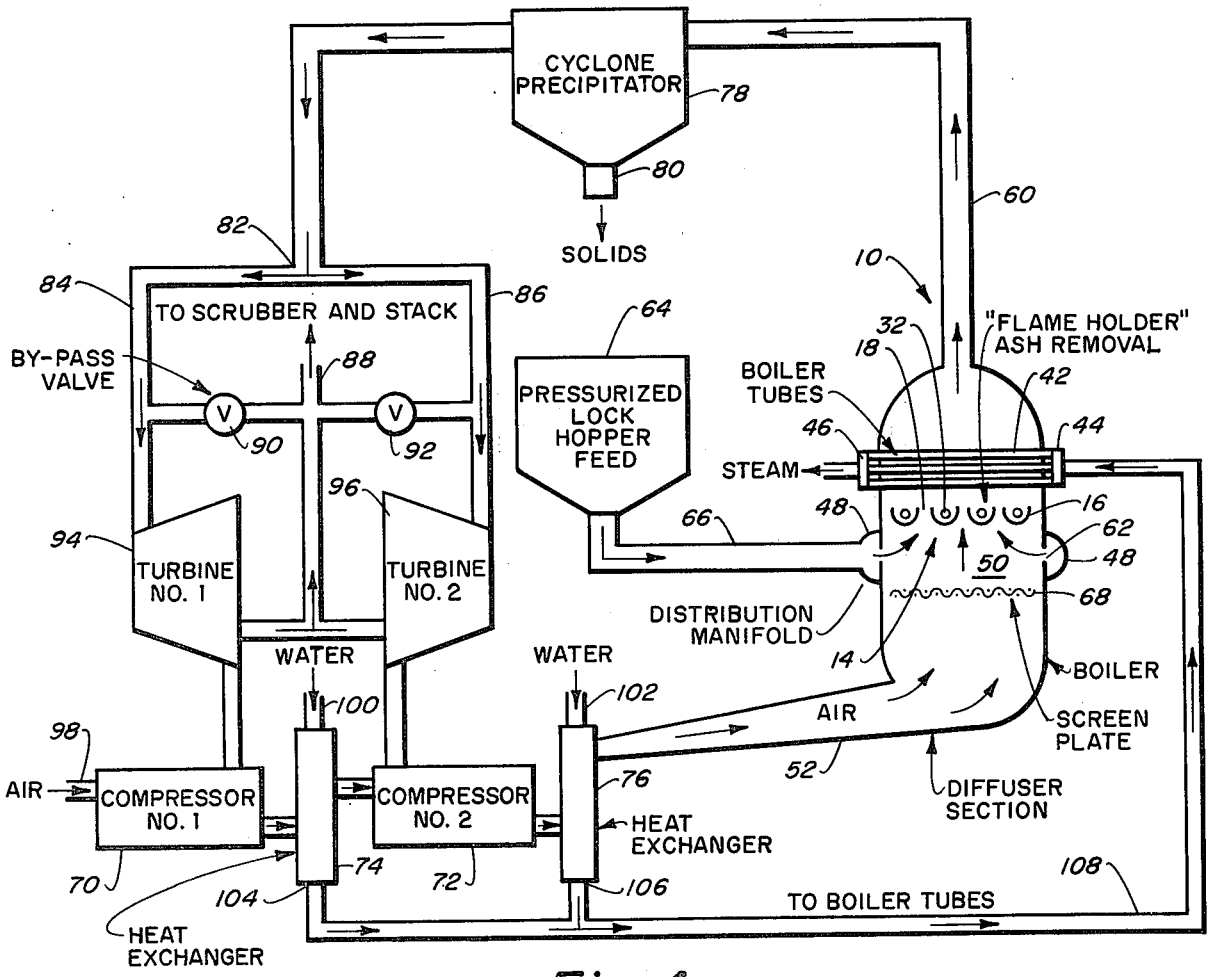
FIG. 4 is a schematic diagram of a pulverized coal-fired, pressurized boiler system in accordance with this invention.

FIG. 4 illustrates the reactor 10 of the invention installed in an overall illustrative pulverized coal-fired pressurized boiler steam generator system showing the use of flue gas to drive the air compressor turbines and the air flow path for preheating boiler water. Pulverized coal or a mixture of pulverized coal and limestone is fed from a pressurized lock hopper 64 through conduit 66 to the coal distribution manifold 48. Coal could also be fed in a plastic state from a screw extruder or ram feed depending on the coal characteristics.

The coal is injected above screen plate 68 into the air stream entering the reactor through inlet 52. The air flow is supplied by two or more staged compressors 70, 72, suitably axial flow compressors. Staging and the interposition of heat exchangers 74, 76 permits attainment of the desired pressure rise while reducing inlet temperature to the downstream compressor 72 as well as to reduce the temperature at inlet 52 to less than 600° F. to preclude plasticizing the incoming coal.

The coal is suspended in the air stream, passes in a controlled manner through the nozzle opening 18 and combusts in the fluidized bed supported in flameholder fashion above the grid 14. The combustion gases leave the reactor through flue 60, pass through cyclone precipitator 78 to remove residual solids 80. The combustion gas stream is split at T-connection 82 into two flow paths 84, 86 communicating with stack and scrubber outlet 88 through by-pass valves 90, 92 and the turbines 94, 96 which drive compressors 70, 72.

Air is fed to compressor 70 from inlet 98 and then through heat exchanger 74, compressor 72 and heat exchanger 76 before entering inlet 52. Water is fed to each inlet 100, 102 of the heat exchangers 74, 76 and the heated water is collected from each outlet 104, 106 into conduit 108 which feeds the boiler tubes 42 through manifold 44. The steam produced at manifold 46 can be utilized to drive power generating turbines and the condensate recovered and fed to water inlets 100, 102.

The reactor of the invention containing the novel, one-dimensional channel-nozzle injector, ash removal and flameholder structure achieves both flow control and flame-holding of the fuel/air mixture while simultaneously achieving continuous, simple ash removal. Maximum effectiveness of heat transfer to the working fluid is achieved by placing the primary heat transfer surface within the combustion zone. The reactor walls can be configured with brazed tube bundles utilizing manufacturing technology of liquid rocket engines. Water flowing through these tubes will not only cool the combustor wall but will also be further preheated prior to entering the tube bundles within the reactor.

It is to be realized that only preferred embodiments of the invention have been described and that numerous substitutions, modifications, and alterations are permissible without departing from the spirit and scope of the invention as defined in the following claims.

What is claimed is:

1. A reactor for combusting a suspension of fluidized carbonaceous fuel comprising in combination:

wall means defining a vertical reaction chamber;

a horizontal grid of upwardly facing channels which are arcuate in shape with outwardly diverging upper ends, said channels being mounted in said reaction chamber with preselected spacing between the channels defining elongate nozzle openings;

ash removal means mounted in each of said channels;

means for injecting a suspension of carbonaceous fuel into said reaction chamber below said grid whereby said suspension is injected through said openings into a combustion zone above said grid; and means for removing combustion gases from said chamber.

2. A reactor according to claim 1 in which said ash removal means includes a worm screw conveyor disposed in each channel.

3. A reactor according to claim 2 in which said wall means includes an aperture communicating with each channel and an elongated sleeve extending from each aperture terminating in a dump chute and said worm screw conveyor extends through said sleeve.

4. A reactor according to claim 1 in which the spacing between channels is from 1/16 inch to 1.0 inch.

5. A reactor according to claim 4 in which the spacing is from $\frac{1}{8}$ inch to $\frac{1}{2}$ inch.

6. A reactor according to claim 1 further including steam generation means mounted in said chamber above said grid.

7. A reactor according to claim 6 in which the steam generation means includes an array of boiler tubes; inlet means for delivering water to one end of the tubes and outlet means for recovering steam from the other end of the tubes.

8. A reactor according to claim 3 wherein said worm screw conveyor fits matingly within said elongated sleeve whereby said ash seals off said aperture during removal of ash from said reactor.

* * * * *